United States Patent [19]

Fealey

[11] 4,452,388

[45] Jun. 5, 1984

[54] SPRING ACTUATED STAPLE DRIVING DEVICE

[75] Inventor: William S. Fealey, Jamestown, R.I.

[73] Assignee: Textron, Inc., Providence, R.I.

[21] Appl. No.: 405,370

[22] Filed: Aug. 5, 1982

[51] Int. Cl.[3] ..... B25C 5/06; B25C 5/10

[52] U.S. Cl. ..... 227/132; 227/120; 227/123; 227/128

[58] Field of Search ..... 227/116, 117, 132, 120, 227/123, 125, 127, 126, 109, 128; 29/432, 432.1

[56] References Cited

U.S. PATENT DOCUMENTS

| | | | |
|---|---|---|---|
| 2,493,640 | 1/1950 | Peterson | 227/132 |
| 3,199,185 | 8/1965 | Lash et al. | 29/434 |
| 3,229,882 | 1/1966 | Abrams | 227/132 |
| 3,275,212 | 9/1966 | Johnson | 227/132 |
| 3,610,505 | 10/1971 | Males | 227/123 |
| 3,758,016 | 9/1973 | Olney et al. | 227/132 |
| 3,948,426 | 4/1976 | La Pointe | 227/132 X |
| 4,126,260 | 11/1978 | Mickelsson | 227/132 |
| 4,156,499 | 5/1979 | Frank | 227/132 |
| 4,184,620 | 1/1980 | Ewig | 227/8 |
| 4,367,833 | 1/1983 | Kenney | 227/132 |
| 4,399,938 | 8/1983 | Biddle | 227/120 |

FOREIGN PATENT DOCUMENTS

| | | | |
|---|---|---|---|
| 2032327 | 10/1978 | United Kingdom | 227/156 |

*Primary Examiner*—Paul A. Bell

*Attorney, Agent, or Firm*—Cushman, Darby & Cushman

[57] ABSTRACT

A spring actuated staple driving device including a combined housing and magazine assembly constructed of an outer metal casing and an interior plastic core, the plastic core being provided by a molded body which provides key functional surfaces which materially aids in the assembly and accuracy of assembly. The device utilizes an elongated leaf spring to effect the staple driving action and provides a direct movement of the leaf spring by the actuating mechanism. The fixed end of the leaf spring is bent to form a segmental cylindrical surface which receives a cylindrical pin portion to control the movement of the leaf spring and an adjusting mechanism for the cylindrical pin is provided.

34 Claims, 10 Drawing Figures

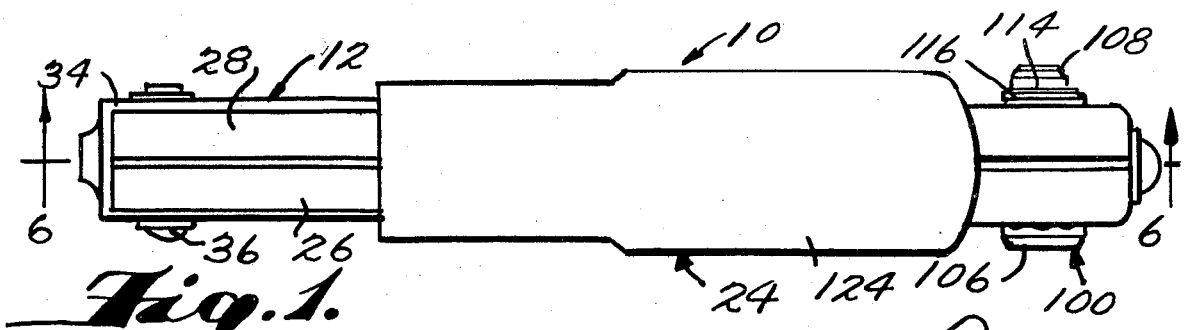
Fig. 1.
Fig. 2.
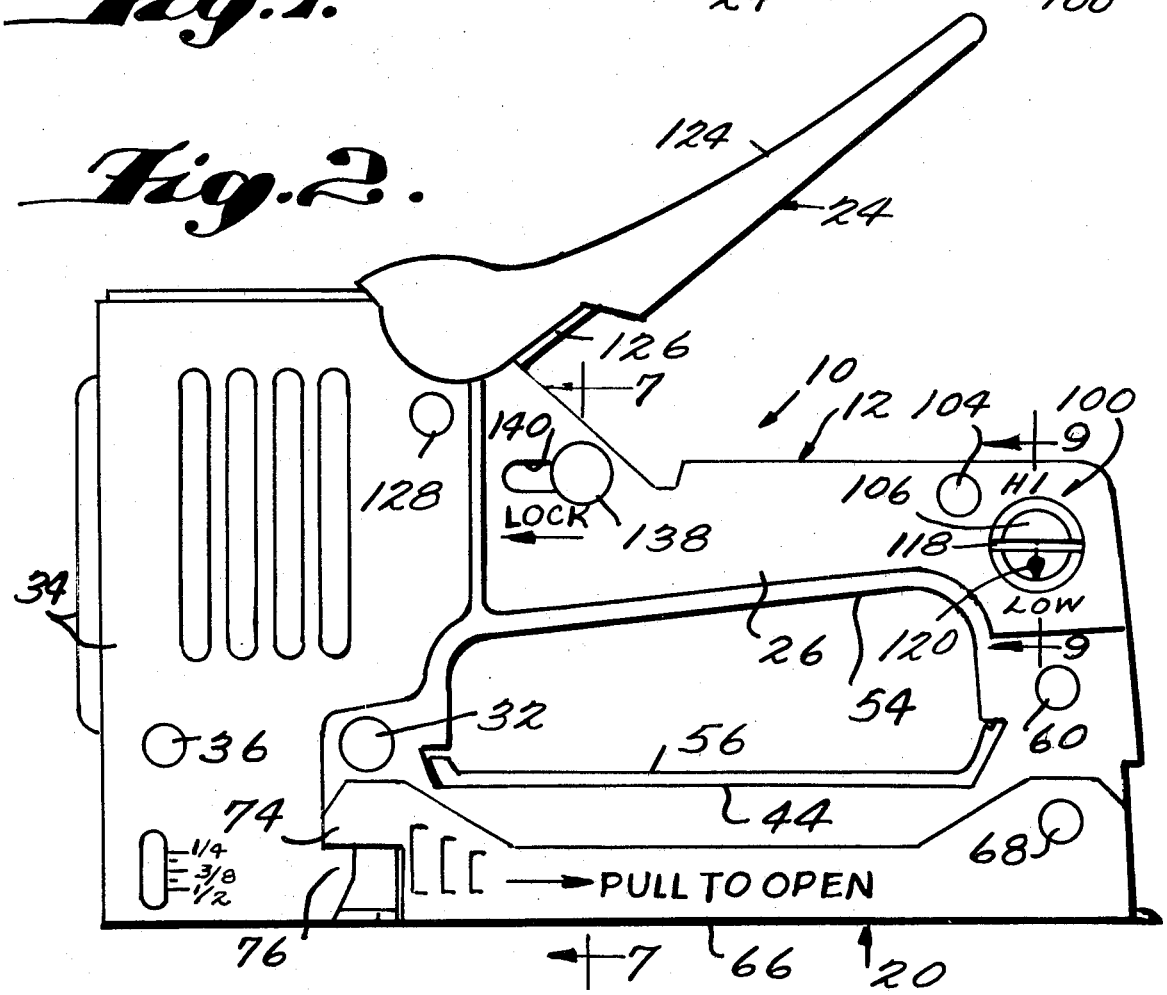
Fig. 3.
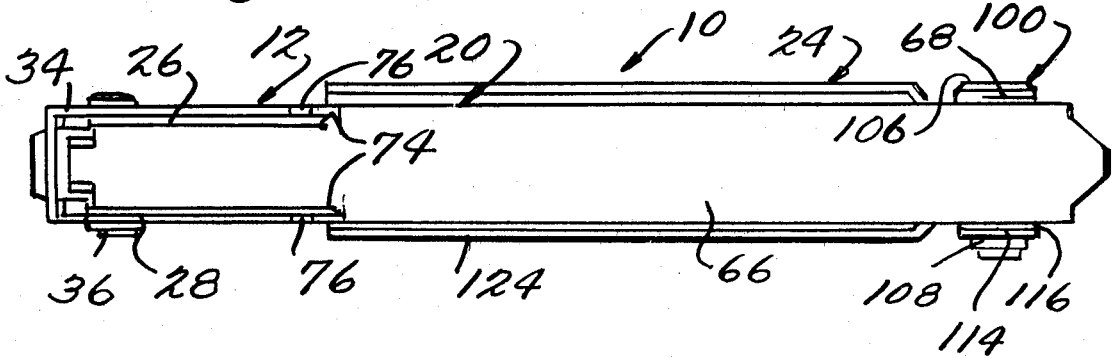

SPRING ACTUATED STAPLE DRIVING DEVICE

This invention relates to fastener driving devices and more particularly to improvements in fastener driving devices of the spring actuated type.

Spring actuated fastener driving devices of the type herein contemplated have been commercially available for many years. There are numerous examples of fastener driving devices of this type in the patented literature. A typical example is found in commonly-assigned U.S. Pat. No. 3,610,505. Other examples include U.S. Pat. Nos. 3,199,185 and 3,758,016. In general, all of these devices embody essentially the same combination of components which includes a housing defining a vertically extending drive track in the forward lower portion thereof and a handle on the rearward upper portion thereof. A magazine assembly is mounted on the housing below the handle and includes a channel for receiving and supporting a stick of fasteners, usually staples. The magazine usually includes a spring pressed pusher which serves to feed the lead fastener of the stick into the drive track so as to be driven therefrom by a fastener driving element slidably mounted in the drive track when the latter is moved through a downward drive stroke. Spring means is provided in the housing for effecting the drive stroke of the fastener driving element and an actuating mechanism is provided for moving the fastener driving element through an upward stroke during which the spring is stressed and for allowing the stressed spring to effect the downward driving stroke as the end of the spring stressed stroke is reached.

The components of the above-cited patents are generally of sheet metal construction and this construction is recognized as presenting a reliable and durable construction. Efforts have been made over the years to render the construction more economical and to reduce the overall weight by forming many of the components, such as the housing or the like, of plastic material. For example, U.S. Pat. No. 3,229,882 discloses a spring tacker in which the handle portion is formed with a molded plastic component. U.S. Pat. No. 3,275,212 discloses a device of this type in which a cantilevered actuating lever is formed primarily of plastic material. The recently issued U.S. Pat. No. 4,184,620, discloses a spring actuated fastener driving device where substantially the entire housing is formed of plastic molded into two half parts. While forming the entire housing of plastic constitutes a maximum saving in material costs and reduction in weight as compared with metal components, there is clearly some sacrifice in the reliability and durability of the device in actual operation.

An object of the present invention is to provide an improved spring actuated fastener driving device which achieves an optimum balance between the reliability and durability provided by sheet metal components and the economy and weight reduction provided by plastic components. In accordance with the principles of the present invention this objective is achieved by combining the housing and magazine into a single assembly which is constructed with a sheet metal outer casing providing opposed vertically extending sides and a molded plastic body fixed in abutting relation between the sheet metal sides. The plastic body is at the core of the device and simplifies assembly of the entire device. Furthermore, it serves to reduce accumulated tolerances normally caused by parts and assemblies not being closely related to one common control point. The molded plastic body also serves to provide several key surfaces in the functioning of the device. The forwardly facing surface of the molded plastic body defines the rearward portion of the drive track above the position of communication of the staple channel therewith. The plastic body provides upwardly facing bumper retaining surfaces on which a separate bumper is supported for operatively arresting the movement of the staple driving element at the end of its staple driving stroke. The molded plastic body also includes a horizontally elongated portion generally coextensive with the staple channel having (1) oppositely facing parallel planar side surfaces spaced apart a distance equal to the width of the channel, (2) a downwardly facing horizontally elongated staple guide surface between the side surfaces defining the portion of the channel for receiving and guiding the upper crown surfaces of a staple stick in the channel, (3) horizontally elongated pusher retaining and guiding surfaces between the side surfaces in communicating relation with the central staple guide surface and (4) a rearwardly facing pusher stop surface disposed in spaced relation with respect to the forwardly facing drive track defining surface for engaging the pusher to prevent the same from entering the drive track. The oppositely facing parallel planar side surfaces serve to determine the width of the staple stick channel by engaging the sheet metal sides which extend downwardly therefrom so as to define (1) the portion of the channel for receiving and guiding the exterior surface of the staple legs of a staple stick received and guided within the channel and (2) the vertical end portions of the drive track.

Preferably, the sheet metal outer casing includes a pair of separate side plates defining the housing sides and a U-shaped sheet metal nosepiece which fits exteriorly over the forward portion of the side plates so as to define the forward portion of the drive track. The position of securement of the nosepiece is determined by a fastener which extends not only through the side plates but the molded plastic body as well. Preferably, the horizontally elongated portion of the molded plastic body defines the lower exterior surface of the handhole of the device.

An important component in any spring actuated fastener driving device is the spring which serves to accomplish the ultimate purpose of the device, namely, the fastener driving function. While there have been many different spring constructions utilized, one construction which presents a particularly desirable characteristic in terms of its spring force and mounting capability within the housing is an elongated leaf or bar spring. An early example of a spring of this type embodied in a staple driving device is contained in U.S. Pat. No. 2,493,640. A more recent U.S. Pat. No. 4,126,260, discloses a leaf spring assembly consisting of a plurality of leaves having the rear end portion mounted within the housing handle. This patent also discloses a mechanism for effecting an adjustment of the spring force, a feature which is desirable particularly when the device is used to drive staples having different leg lengths.

It is a further object of the present invention to provide improvements relating to the utilization of an elongated leaf spring in a fastener driving device of the type herein contemplated. One important improvement in accordance with the principles of the present invention is the direct utilization of the leaf spring as the structural element which is moved by the actuating mechanism of the device. By effecting the cyclical movement of the device through direct engagement with the leaf spring provided a desirable simplicity in the fastener driving element normally used to effect movement and a desirable simplicity and effectiveness in the actuating mechanism is achieved. Moreover, the inherent nature of the leaf spring is such as to provide desirable wear characteristics.

Preferably, the actuating mechanism includes a pawl mounted on the forward end of the actuating lever, the pawl having hook portions for engaging the leaf spring. The pivotal axis of the pawl and the releasable engagement of the hook portions with the leaf spring are so relatively positioned that the movement of the lever through a predetermined initial portion of its manually engaged stroke serves to pivotally bias the hook portions of the pawl into engagement with the leaf spring as the latter is moved with the staple driving element through a corresponding initial portion of the spring stressing stroke of the latter. Preferably the lever is provided with an abutment which engages the pawl and prevents further pivotal movement of the pawl with respect to the lever after the predetermined initial portion of its manually engaged stroke so that during the further movement of the lever the pawl is moved in fixed relation with the lever to effect the release of the hook portions from the leaf spring. Preferably, the forward end portion of the leaf spring is of reduced width so as to provide a pair of transversely spaced forwardly facing shoulders which are engaged by the pawl so that the hook portions can extend beneath the same for lifting the forward end of the leaf spring. Preferably the pawl is spring biased to engage the abutment during the further movement of the lever as aforesaid and the hook-shaped portions include downwardly and rearwardly facing cam surfaces for engaging the shoulders during the return stroke of the lever to pivot the pawl in a direction against its spring bias so as to enable the hook-shaped portions to engage beneath the shoulders.

Another improvement associated with the leaf springs utilized in accordance with the principles of the present invention relates to the manner in which the rear end portion of the leaf spring is fixedly connected with the housing of the device. This connection preferably is within the hollow handle of the device and is accomplished by a pair of pins extending between the side plates defining the handle, the pins being disposed on opposite sides of the leaf spring. One of the pins, preferably the rearwardmost one which is below the leaf spring, includes a cylindrical exterior surface for engaging the spring and the adjacent portion of the spring is bent to provide a transversely extending groove defining a segmental cylindrical pin engaging surface disposed with its axis concentric with the axis of the cylindrical pin surface. With this construction the rearward end portion of the leaf spring is retained in its operative position against unwanted movement out of operating position in both the longitudinal and transverse directions.

Another improvement associated with the utilization of a leaf spring in accordance with the principles of the present invention relates to the provision of a simplified adjusting mechanism for varying the spring force exerted by the leaf spring in the fastener driving function. The adjustment is accomplished by utilizing one of the aforesaid pins, preferably the rearwardmost one, as the adjusting means. The one pin is mounted for pivotal movement about a transversely extending axis for movement into a plurality of different positions of pivotal movement. A detent arrangement is utilized to releasably retain the pin in its various positions of pivotal movement. The pin is provided with a central cylindrical portion which engages the leaf spring and has its axis disposed eccentric to or parallel with the axis of pivotal movement of the pin. Indicia is provided for indicating the position of adjustment of the pin.

Preferably, the detent arrangement includes a series of annularly spaced projections formed on the housing side plate and a corresponding series of complementary recesses or depressions formed on the head of the pin, the opposite end of which has an annular spring connected therewith for releasably retaining the projections and depressions in registry. Preferably the head of the pin is provided with an exterior slot enabling an operator to pivot the pin by means of a coin engaged within the slot.

These and other objects of the present invention will become more apparent during the course of the following detailed description and appended claims.

The invention may best be understood with reference to the accompanying drawings, wherein an illustrative embodiment is shown.

In the drawings:

FIG. 1 is a top plan view of a fastener driving device embodying the principles of the present invention;

FIG. 2 is a side elevational view of the device;

FIG. 3 is a bottom view of the device;

Figure 6:
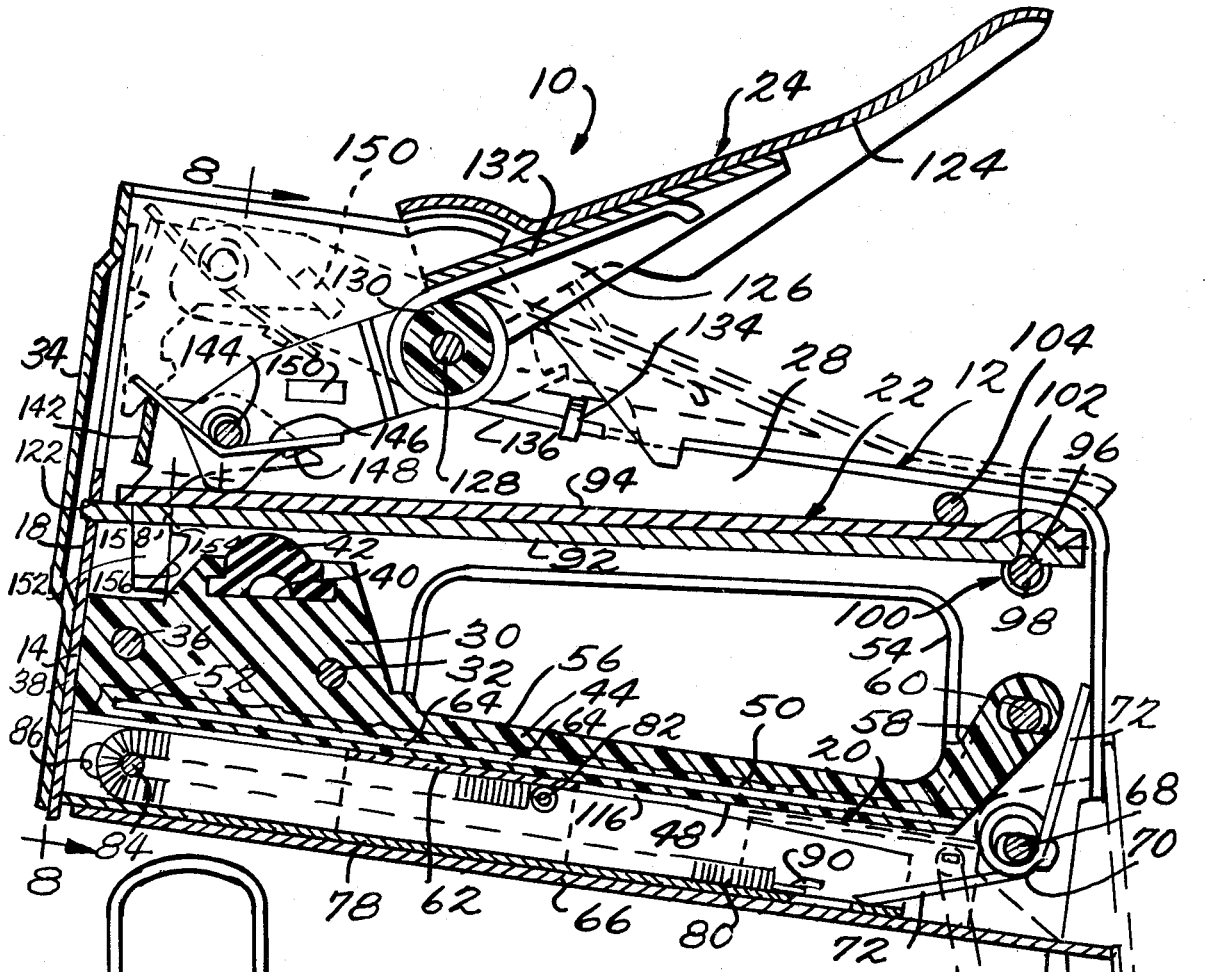
FIG. 6 is a sectional view with parts further broken away taken along the line 6—6 of FIG. 1 showing in dotted lines the position of the lever and pawl at the end of the spring stressing stroke of the fastener driving element and the staple loading position of the access member of the magazine.
Figure 4:
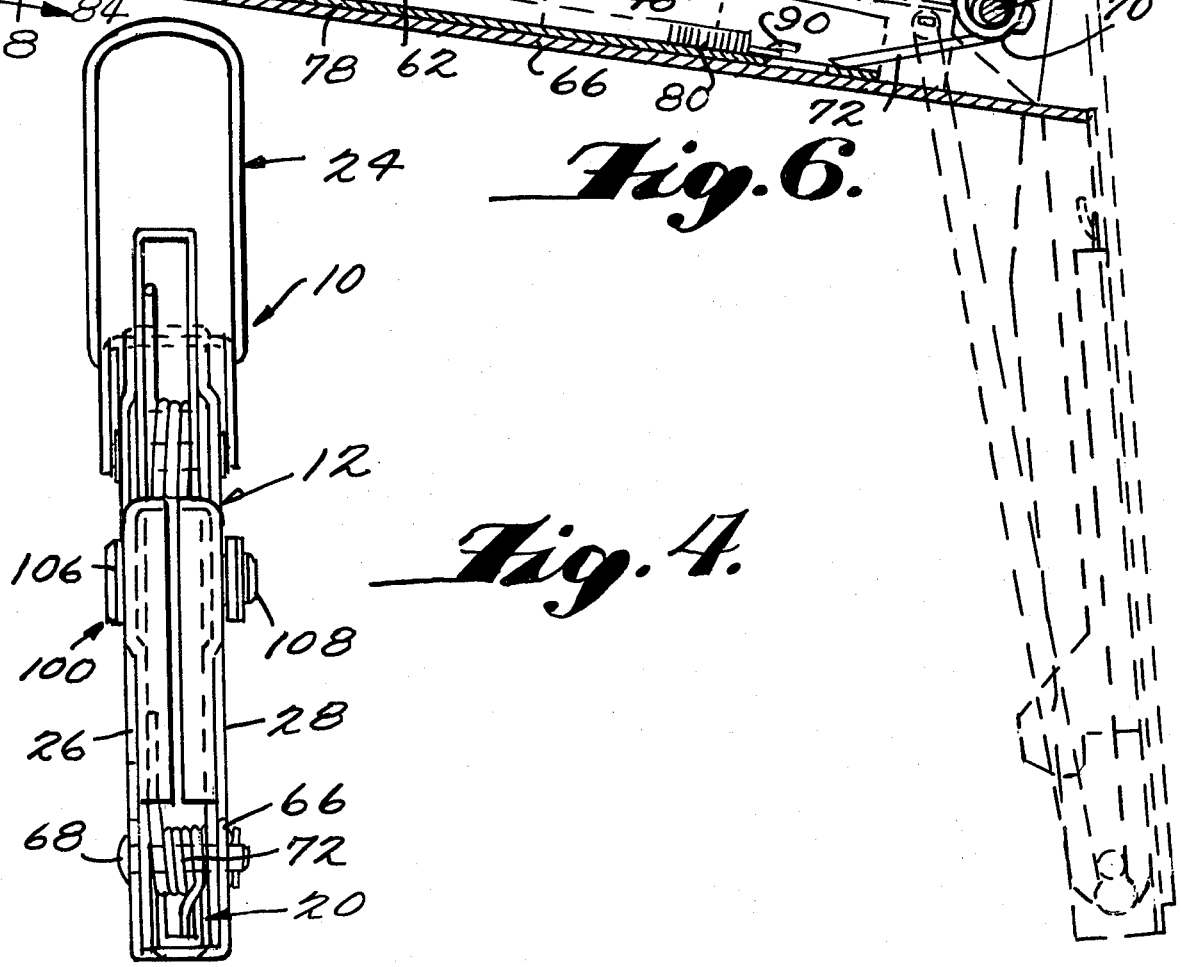
FIG. 4 is a rear elevational view of the device.
Figure 5:
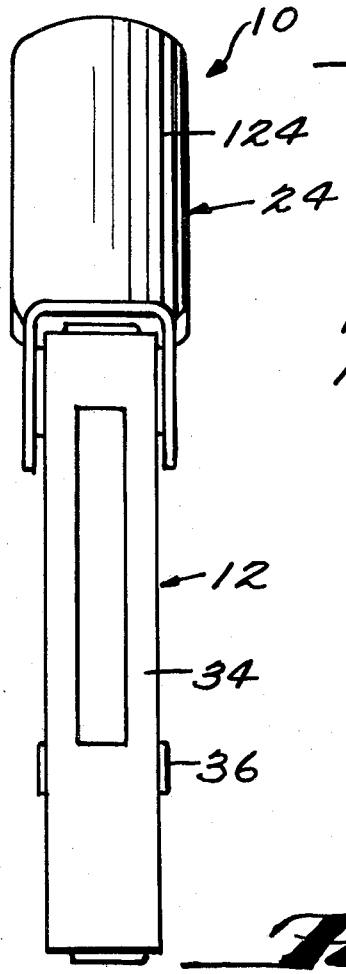
FIG. 5 is a front elevational view of the device.

Referring now more particularly to the drawings, there is shown therein a fastener driving device, generally indicated at 10, which embodies the principles of the present invention. The fastener driving device 10 shown in the drawings is of the type adapted to drive staples in the form of a staple stick. It will be understood, however, that the device may be adapted for driving other types of fasteners as, for example, brads, T nails and the like. The device 10 includes in general a combined housing and magazine assembly, generally indicated at 12, which defines a generally vertically extending drive track 14 in the lower forward portion thereof and a horizontally extending staple stick receiving and guiding cavity 16 along the lower portion thereof which communicates at its forward end with the lower rearward portion of the drive track. Mounted within the drive track 14 is a staple driving element 18. The staple driving element is vertically slidable within the drive track 14 through repetitive cycles each of which includes an upward spring stressing stroke during which the lead staple of the staple stick within the cavity 16 is fed into the drive track 14 by a magazine feeding mechanism, generally indicated at 20. Each operating cycle of the staple driving element 18 also includes a downward staple driving stroke during which the staple within the drive track is driven outwardly therefrom by the staple driving element into the workpiece. In order to effect the staple driving stroke of the staple driving element 18 there is provided an elongated leaf spring assembly 22 and in order to move the staple driving element 18 through its spring stressing stroke and to allow the leaf spring assembly 22 to move the staple driving element 18 through its staple driving stroke there is provided an actuating mechanism, generally indicated at 24. It will be understood that throughout the present specification and claims the terms "vertical", "horizontal", "forward", "rearward", etc. are used in their relative sense rather than their absolute sense, in that the device 10 is portable and adapted to be used in any operative position.

The housing and magazine assembly 12 is constructed so as to include a sheet metal outer casing fixedly secured to an interior plastic core. The sides of the sheet metal outer casing is provided by a pair of sheet metal side plates 26 and 28 which are fixedly mounted on opposite sides of the interior core in the form of a molded plastic body 30. The plastic body 30 may be of any suitable plastic material, a preferred material being polyoxymethylene, a specific example of which is sold under the trademark DELRIN®. The plastic body 30 is fixedly secured between the side plates 26 and 28 by any suitable fastening means, such as rivet 32, extending through the side plates and plastic body and retaining the same in abutting relation. The outer metal casing also includes a third sheet metal component in the form of a U-shaped nosepiece 34 fitted over the forward portion of the side plates 26 and 28 so that the interior surfaces of the legs thereof engage the adjacent forward exterior surfaces of the side plates. The nosepiece 34 is secured in fixed relation by a second fastener 36 extending through the legs thereof and the associated portions of the side plates 26 and 28 and plastic body 30.

It will be noted that the drive track 14 is defined at its ends by the forward interior surfaces of the side plates 26 and 28 and at its forward portion by the interior lower surface of the bight portion of the U-shaped nosepiece 34. The plastic body 30 is formed with a forwardly extending planar surface 38 (see FIG. 6) which defines the rearward portion of the drive track at a position above its communication with the staple cavity 16. The upper surface of the plastic body 30 between the fasteners 32 and 36 is formed with an interior T-shaped slot 40 defining bumper receiving surfaces within which an elastomeric bumper 42 is secured. Preferably, the adjacent portions of the side plates 26 and 28 are likewise slotted to receive the opposite ends of the bumper 42. As shown, the elastomeric bumper is formed of elastomeric polyurethane having a Shore A durometer of 70–85 and includes a central upwardly facing dome portion which is adapted to be engaged by the leaf spring assembly 22 when the latter is in its lowermost position.

Figure 7:
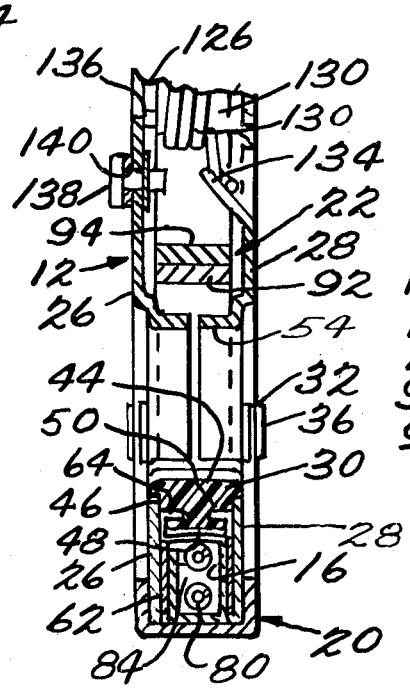
FIG. 7 is a fragmentary sectional view taken along the line 7—7 of FIG. 2.

The plastic body 30 is formed with a horizontal extending portion 44 which is generally horizontally coextensive with the staple stick cavity 16. As best shown in FIGS. 6 and 7, the elongated body portion 44 includes a pair of oppositely facing planar parallel side surfaces 46 which serve to abuttingly receive corresponding interior surfaces of the side plates 26 and 28, the lower portions of which extend downwardly therebelow so that the interior surfaces thereof define the sides of the cavity 16 which guidingly receive the exterior surfaces of the legs of the staple stick. The elongated body portion 44 also includes a central downwardly facing surface 48 defining the upper portion of the cavity 16 which guidingly receives the upper crown surfaces of the staple sticks. Disposed between the side surfaces 46 and communicating with opposite sides of the central cavity defining surface 48 is a plurality of horizontally elongated surfaces defining a pair of L-shaped slots 50. The slots 50 extend forwardly and terminate in rearwardly facing stop surfaces 52, as is clearly shown in FIG. 6.

The central portions of the side plates 26 and 28 are formed with registering openings defining a handhole 54 in the housing and magazine assembly 12. The body portion 44 which is coextensive with the handhole 54 includes a textured upwardly facing exterior surface 56 which extends over and bridges the gap between the lower portion of the openings defining the handhole 54. The remaining upper portion of the handhole 54 is defined by turning in the marginal edge portions of the side plates defining the opening so as to present a relatively smooth exterior surface. It will be noted that the upper and rearward marginal edge portions of the side plates are likewise turned inwardly toward one another so that the upper portions define a hollow handle construction. It will also be noted that the plastic body 30 includes a rearward upwardly extending extension 58 which is suitably apertured and secured between the rear end portion of the side plates, as by a fastener 60.

The feeding mechanism 20 includes a U-shaped pusher 62 which is configured to engage the interior surfaces of the side plates defining the cavity 16 in a position below the surface 48 of the body portion 44. Struck from the bight portion of the pusher 62 are four L-shaped tabs 64 of a size and shape to engage within the L-shaped slots 50. In this way the pusher 62 is slidably carried by the elongated portion 44 of the plastic body 30 for reciprocating movement along and within the cavity 16. It will be noted that the forward surfaces of the forward L-shaped tabs 64 are spaced rearwardly of the forward edge of the pusher 62 a distance slightly less than the spacing between the surfaces 38 and 52 provided by the plastic body. In this way stop surfaces 52 serve to prevent the pusher 62 from entering the drive track 14.

The feed mechanism 20 also includes a pivoted access structure formed in part by a bottom access member 66 which is of U-shaped cross-sectional configuration, the spacing between the legs being such that they are capable of engaging on opposite exterior surfaces of the lower portions of the side plates 26 and 28. The rearward end of the legs of the U-shaped bottom member 66 are apertured to receive a transverse pin 68 which also extends through a pair of elongated slots 70 formed in transversely aligned relation within the lower rearward portions of the side plates 26 and 28. A torsion spring 72 has its central coil portion connected around the pin 68 with one end extending upwardly into engagement with the rear surface of the inturned marginal rear edge of one of the side plates. The opposite end portion of the spring 72 extends forwardly and operatively engages the pivoted access structure. The spring 72 therefore serves to resiliently urge the pin 68 and hence the bottom member 66 fixed thereto forwardly within the slot 70 and to resiliently urge the bottom member 66 to move in a counterclockwise direction, as viewed in FIG. 6, about the pivotal axis provided by the pin 68.

As best shown in FIG. 2, the forward edge portion of the legs of the bottom member 66 are formed into a downwardly facing hook configuration, as indicated at 74, so as to engage over a correspondingly configured upwardly facing hook portion 76 formed on the adjacent lower rearward edge portion of the U-shaped nosepiece 34. It can be seen from FIG. 2 that the hook portions 74 and 76 when interengaged constitute a releasable latch for retaining the pivoted access structure in an operative position and that the spring 72 enables the access structure to be yieldably moved rearwardly so as to disengage the latch and permit the access structure to be pivoted into an open staple stick loading position, as shown in dotted lines in FIG. 6, with the aid of the bias provided by the spring 72.

The access structure also includes a core member 78 of U-shaped cross-sectional configuration mounted within the bottom member 66 so that the exterior surface of its bight portion abuttingly engages the central interior surface of the bight portion of the bottom member 66. The legs of the core member 78 extend upwardly in parallel relation to the interior surfaces of the side plates defining the cavity 16 so as to guidingly receive the interior surfaces of the legs of the staple stick. The upper surface of the legs of the core member 78 engage beneath the staple stick crowns and the forward edges thereof serve to perform the staple cut-off function by retaining the staple next to the lead staple from being driven with the lead staple. The core member 78 also serves to mount an elongated coil spring 80 which functions to bias the forward edge of the pusher 62 into engagement with the trailing edge of the staple of the stick within the cavity 16 so as to urge the lead staple in a direction toward the drive track 14. It will be noted that one end of the coil spring 80 is connected with a tab 82 struck from the bight portion of the pusher 62 and that the spring extends forwardly therefrom around a roller 84 engaged within key-shaped slots 86 formed in the forward portions of the legs of the core member 78. From the roller 84 the spring 80 extends rearwardly and has its opposite end anchored to a tab 90 struck from the bight portion of the core member 78. It can be seen that the arrangement is such that when the access structure is disposed in its normal operating position as shown in full lines in FIG. 6, the coil spring 80 serves to bias the pusher 62 in a forward direction by virtue of the portion thereof anchored to the pusher tab 82 which extends forwardly around the roller 84. As the access structure is pivoted from its operating position, shown in solid lines in FIG. 6, to its staple loading position shown in dotted lines, the position of roller 84 changes with respect to the position of the tab 82 so that the bias of the spring 80 on the pusher 62 changes from a forward bias to a rearward bias. Consequently, when the access structure is fully in its open staple loading position, as shown in dotted lines in FIG. 6, pusher 62 is biased into its rearwardmost position, thus rendering the entire portion of the cavity 16 forwardly thereof open to receive a new staple stick. It will be understood that after the cavity 16 has been loaded with a staple stick, the access structure is then simply pivoted back into its normal operating position against the bias of spring 72 during which movement the spring 80 bias on the pusher 62 is again reversed to a forward bias. At the end of this movement hook portions 74 and 76 are interengaged to latch the access structure in its operating position.

Referring now more particularly to FIGS. 2, 6, 9 and 10, it can be seen that the leaf spring assembly 22 includes a plurality of spring leaves 92 and 94 mounted in generally longitudinally coextensive abutting relation with respect to one another. The rearward end of the lower spring leaf 92 is bent to provide an annular groove defining a downwardly facing segmental cylindrical surface 96 which is adapted to engage a cylindrical exterior surface of a cylindrical portion 98 of an adjustable pin assembly 100 mounted between the upper rearward portion of the side plates 26 and 28 at the rearward end of the hollow handle thereof. The rearward end of the upper spring leaf 94 is likewise bent to provide a downwardly facing groove, the surface 102 of which, however, is arcuate about the same center as the surface 96. In addition to the adjustable pin assembly 100, the rearward end portion of the leaf spring assembly 22 is fixed between the side plates 26 and 28 by a second pin 104 which extends between the side plates in a position to engage above the upper surface of the upper spring leaf 94 in forwardly spaced relation with respect to the adjustable pin assembly 100. The two pin arrangement serves to anchor the rearward end portion of the leaf spring assembly 22 so that it will be stressed as the forward end is moved upwardly.

Figure 10:
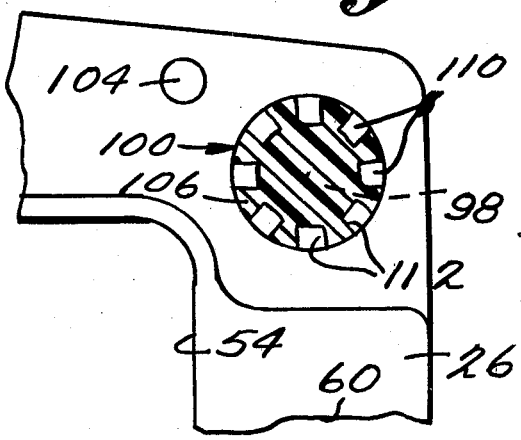
FIG. 10 is a fragmentary sectional view taken along the line 10—10 of FIG. 9.
Figure 9:
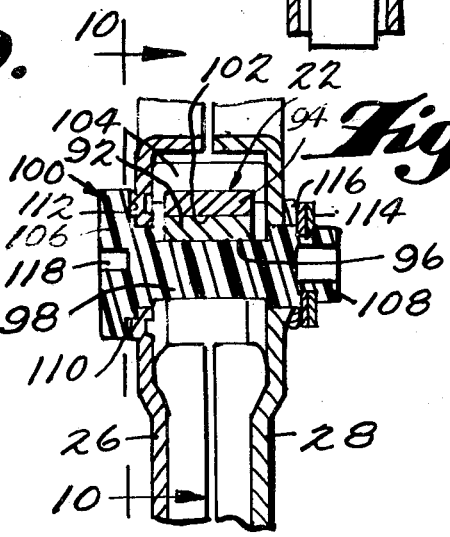
FIG. 9 is a fragmentary sectional view taken along the line 9—9 of FIG. 2.

As best shown in FIGS. 9 and 10, the cylindrical portion 98 of the adjustable pin assembly 100 forms the central portion of a pin made of plastic, such as DELRIN®, which includes an enlarged head 106 on one end thereof and a free end portion 108 on the opposite end thereof. The head 106 includes an inner portion of reduced diameter, which together with the free end portion 108 serves to support the pin within registering openings for pivotal movement about an axis extending transversely with respect to the side plates and longitudinally with respect to the pin. Formed between the enlarged head 106 and the associated portion of the side plate 26 is a detent means in the form of a plurality of annularly spaced projections 110 formed in the side plate 26 and a corresponding series of annularly spaced depressions or recesses 112 formed in the inwardly facing surface of the enlarged head portion 106. The free end portion 108 is suitably slotted to receive a retaining ring or rings 114 and an annular spring 116 is mounted between the retaining rings and the associated portion of the side plate 28 so as to resiliently urge the enlarged head 106 into engagement with the side plate 26. As shown, there are eight projections 110 and a corresponding number of recesses 112. The spring 116 serves to resiliently bias the projections 110 within the recesses 112 and to yield so as to permit pivotal adjustment of the pin assembly 100 about the axis of pivotal movement provided by the end portion 108 and the reduced inner portion of the enlarged head 106. This axis of pivotal movement is eccentric to or parallel with respect to the axis of the cylindrical portion 98 so that as the pin assembly 100 is moved into different positions of pivotal movement, as determined by the interengagement of the detent means, the central eccentric cylindrical portion 98 will assume different positions with respect to the fixed pin 104. In order to aid in turning the pin assembly 100 the enlarged head portion 106 is formed with a coin slot 118.

The position of adjustment of the adjustable pin assembly 100, as shown in FIGS. 2, 6, 9 and 10, corresponds with one limiting position within the range of adjustment provided, namely the limiting position where the least amount of pre-stress is applied to the leaf spring assembly 22 when the same is disposed in its lowermost position. Stated differently, the limit position shown constitutes the greatest vertical spacing between the fixed pin 104 and the movable pin portion 98. In the embodiment shown there are five incremental positions of adjustment provided by the detent means defining an extent of pivotal movement of the pin of 180°. The other limiting position corresponds with the greatest amount of pre-stress applied to the leaf spring 22 when in its lowermost position. It will be understood that the amount of stress applied to the leaf spring 22 as it moves with the staple driving element 18 through the spring stressing stroke of the latter is determined by the amount of pre-stress initially applied. In order to provide the operator with a clear indication of the position of adjustment, the exterior surface of the pin head 106 is provided with an arrow 120 and stress amount indicating indicia such as hi and low is provided on the exterior surface of the associated side plate 26 in cooperating relation with respect to the arrow 120.

Figure 8:
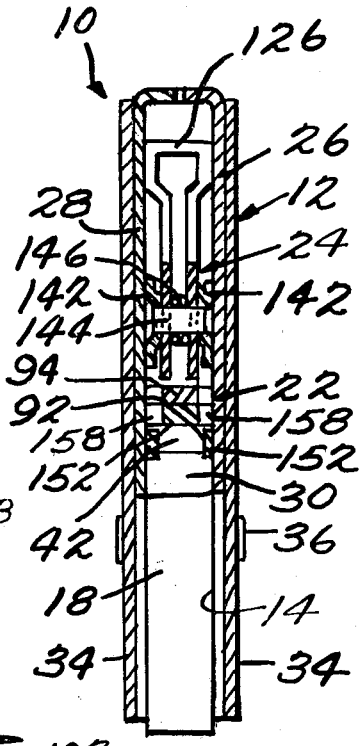
FIG. 8 is a sectional view taken along the line 8—8 of FIG. 6.

Referring now more particularly to FIGS. 6 and 8 of the drawings, it can be seen that the forward end portion of each of the spring leaves 92 and 94 has a reduced width. The forward extremity of the reduced width of the lower spring leaf 92 extends into an opening 122. The interengagement of the exterior cylindrical surface of the eccentric pin portion 98 with the segmental cylindrical surface 96 formed in the lower spring leaf 92 serves to prevent unwanted longitudinal movement of the lower spring leaf 92 as aforesaid and consequently the simple projection of the forward extremity of the lower spring leaf 92 through opening 122 serves to effect the operative connection between the leaf spring assembly 22 and the staple driving element.

The actuating mechanism 24 includes two main components, one a lever structure which is pivoted intermediate its ends between the side walls 26 and 28 at the upper central portion thereof and the other a pawl structure which is pivoted on the forward end of the lever structure. The lever structure includes a manually engaged member 124 which is configured in generally shallow inverted U-shaped configuration so as to accommodate manual engagement. The lever structure also includes a pivoted member 126 which includes a rearward arm portion of generally inverted U-shaped configuration having the upper exterior surface of its bight portion rigidly secured, as by welding or the like, to the interior lower surface of the bight portion of the manually engaged member 124. The central portion of the depending legs of the member 126 are apertured to receive therethrough a pivot pin 128 which also extends through registering openings in the upper central portion of the side plates 26 and 28 at a position forwardly of the hollow handle construction provided thereby. The pin 128 serves to mount the lever structure for pivotal movement through repetitive oscilatory cycles, each including a manually engaged stroke corresponding with the spring stressing stroke of the staple driving element 18 and a return stroke. During the manually engaged stroke the manually engaged lever member 124 is moved from the upper full line position, as shown in FIG. 6, to a lower position, shown in dotted lines in FIG. 6, wherein the lever member 124 is disposed closely adjacent the handle construction provided by the side plates 26 and 28.

Rotatably mounted on the central portion of the pin 128 between the legs of the pivot member 126 is an annular spring support 130. A torsion spring 132 has its coil disposed around the support 130 with one end portion thereof extending rearwardly in engagement beneath the bight portion of the pivoted lever member 126. The opposite end of the torsion spring 132 also extends rearwardly and is engaged in a tab 134 struck from the adjacent portion of the side wall 28. Spring 132 serves to bias the manually engaged lever member 124 to its uppermost position, as shown in full lines in FIG. 6.

Referring now more particularly to FIGS. 6 and 7, it will be noted that the depending leg of the pivot member 126 adjacent the side plate 26 has a hook portion 136 (shown in phantom lines in FIG. 6) which is adapted to be engaged by the inner end of a locking button 138 suitably mounted within a horizontally extending slot 140 formed in the adjacent portion of the side plate 26. It will be noted that with the locking button 138 in its rearwardmost position, as shown in FIG. 2, the inner end thereof is disposed out of the path of movement of the locking hook 136 when the lever structure is pivoted through its cycle of movement. When the lever is pivoted through its manually engaged stroke into the dotted line position shown in FIG. 6, the locking hook 136 is disposed in a position below the forward end of the slot 140 so that by retaining the lever structure in its lowermost position and moving the locking button 138 forwardly within the slot 140, the inner end of the locking button will engage the locking hook 136 when the lever structure is released and thus retain the same in its lowered or storage position.

The pawl of the actuating mechanism 24 is formed from a metal member 142 which is bent into a U-shaped configuration disposed with its bight portion extending generally vertically and with the legs outwardly of the forward arm portion of the legs of the pivoted lever member 126. A pivot pin 144 serves to effect a pivotal connection between the pawl member 142 and the forward arm portion of the pivoted lever member 126. In this regard it will be noted that parallel legs defining the forward arm portion of the pivot lever member 126 are bent inwardly intermediate their ends so that the forward ends will accommodate the spacing of the legs of the pawl member 142. A torsion spring 146 has its central coil disposed around the pivot pin 144 with one end portion thereof extending forwardly and engaging the bight portion of the pawl member 142. The opposite end portion of the hairpin spring 144 extends rearwardly and engages a tab 148 bent upwardly from the edge portion of one of the legs of the pivoted lever member 126. Spring 146 thus serves to resiliently bias the pawl member 142 to pivot in a counterclockwise direction, as viewed in FIG. 6, about the axis of the pin 144. When the lever structure is disposed in its locked lowermost position, as shown in dotted lines in FIG. 6, pawl member 142 pivots under the bias of spring 146 about the axis of pin 144 into a limiting position determined by the abutment of the upper surface of the legs of the pawl member with a pair of abutments 150 struck outwardly from the legs of the pivoted lever member 126.

The pawl member 142 includes a pair of depending hook portions 152 extending downwardly from the forward lower edges of the legs of the pawl member. The hook portions 152 include upwardly facing spring engaging surfaces 154 and cam surfaces 156 extending downwardly and forwardly therefrom. As best shown in FIG. 8, the reduced width of the forward end of the lower spring leaf 92 defines thereon a pair of transversely spaced forwardly facing shoulders 158 which are disposed in a position to be engaged by the cam surfaces 156 when the lever structure is moved through its return stroke from the dotted line position shown in FIG. 6 to the full line position shown therein. It will be noted that during the latter portion of this movement cam surfaces 156 will engage the shoulders 158 causing the pawl member 142 to pivot about the axis of pin 144 in a clockwise direction, as viewed in FIG. 6, against the bias of spring 146. During this pivotal movement the legs of the pawl member are moved away from abutting engagement with the abutments 150. Toward the end of the return stroke of the lever structure, cam surfaces 156 move out of engagement with the shoulders 158 permitting the pawl member 142 to pivot about the axis of pin 144 in a counterclockwise direction, as viewed in FIG. 6, under the bias of spring 146 to engage the surface 154 beneath portions of the spring leaf 92 adjacent the shoulders 158. This position of the pawl which is illustrated in full lines in FIG. 6 may be regarded as a normal initial position of operation.

In operation the operator grasps the device in one hand with the fingers beneath the handle construction and the thumb over the manually engaged lever member 124. By effecting a squeezing action the lever structure is pivoted in a counterclockwise direction, as viewed in FIG. 6, from the full line position shown therein through its manually engaged stroke into the dotted line position. During this movement it will be noted that pin 144 moves through an arc which initially extends upwardly and forwardly as viewed in FIG. 6. The position of engagement of the hook surfaces 154 of the pawl member 142 beneath the lower spring leaf 92 likewise moves in an arcuate path determined by the rear mounting of the leaf spring assembly 22 which extends upwardly and forwardly, as viewed in FIG. 6. The relative position of the pivot points is such that the pawl member 142 is biased by the movement of the lever structure to retain its position of engagement beneath the shoulders 158. To this kinematic bias is added the bias of spring 146 so that during an initial predetermined portion of the manually engaged stroke of the lever structure, the hook portions of the pawl member 142 will remain in engagement beneath the shoulders 158 and pivot with respect to the lever structure in a counterclockwise direction about the axis of the pin 144, as viewed in FIG. 6. At the end of this initial predetermined movement, the upper surface of the legs of the pawl engage abutments 150 thus preventing further relative pivotal movement between the lever and pawl structures. As the lever structure moves beyond the initial predetermined amount of movement in its manually engaged stroke the pawl member 142 moves in fixed relation with the lever structure about the pivotal axis provided by the pin 128. The movement of the hook surfaces 154 of the pawl member 142 is now along a path which diverges from the path of movement of the spring shoulders 158 so that at the end of the stroke, the surfaces 154 move out of engagement with the spring leaf 92, thus releasing the entire spring assembly 22 so that the stressed condition thereof will effect the downward staple driving stroke of the staple driving member 18. During this stroke the leading staple which is positioned within the drive track 14 under the bias of pusher 62 and spring 80 is engaged by the staple driving element, stripped from the remaining staples of the stick and moved outwardly of the drive track into the workpiece. It will be noted that at the end of the staple driving stroke, spring assembly 22 engages bumper 42 which aids in arresting the movement of the spring assembly and the fastener driving element into the end of its drive stroke.

After the driving action has been accomplished the operator need only release the grip on the manually engaged lever member 124, permitting spring 132 to move the lever member through its return stroke. During the return stroke the hook portions 152 of the pawl member 142 are engaged beneath the spring shoulders 158 by virtue of the engagement of cam surfaces 156 therewith, as aforesaid.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a portable spring actuated staple driving device comprising a housing and magazine assembly providing a forwardly disposed vertically extending drive track and a horizontally elongated staple stick receiving and guiding channel communicating at its forward end with said drive track intermediate the ends of the same, a vertically extending staple driving element slidably mounted in said drive track for movement through successive staple driving cycles each including an upward spring stressing stroke and a downward staple driving stroke, said housing and magazine assembly including a spring pressed pusher for engaging the trailing staple of a staple stick received and guided within said channel and feeding the leading staple thereof into said drive track during the spring stressing stroke of said staple driving element, spring means operatively connected with said staple driving element so as to be stressed during the movement of said staple driving element through its spring stressing stroke, actuating means for moving said staple driving element through its spring stressing stroke and allowing said spring means to move said staple driving element through its staple driving stroke, the improvement which comprises said housing and magazine assembly including a sheet metal outer casing providing opposed vertically extending sides and a molded plastic body fixed in abutting relation between said sheet metal sides, said molded plastic body having forwardly facing surface means defining the rearward portion of said drive track above the position of communication of said channel therewith and upwardly facing bumper retaining surface means, a separate bumper supported in said bumper retaining surface means for operatively arresting the movement of said staple driving element at the end of its staple driving stroke, said molded plastic body including a horizontal elongated portion generally coextensive with said channel having (1) oppositely facing parallel planar side surfaces spaced apart a distance equal to the width of said channel, (2) downwardly facing horizontally elongated staple guide surface means between said side surfaces defining the portion of said channel for receiving and guiding the upper crown surfaces of a staple stick in said channel, (3) horizontally elongated pusher retaining and guiding surfaces between said side surfaces in communicating relation with said staple guide surface means, and (4) rearwardly facing pusher stop surface means disposed in spaced relation with respect to said forwardly facing drive track defining surface means for engaging said pusher to prevent the same from entering said drive track, said sheet metal sides engaging said side surfaces and extending downwardly therefrom so as to define the portion of said channel for receiving and guiding the exterior surfaces of the staple legs of a staple stick received and guided within said channel and the vertical end portions of said drive track.

2. The improvement as defined in claim 1 wherein said sheet metal sides are provided by a pair of metal side plates fixed to said plastic body by a fastener extending therethrough and through said plastic body.

3. The improvement as defined in claim 2 wherein said metal side plates are formed with registering horizontal openings extending through the central portions thereof so as to provide a handhole for a handle defined thereabove, said horizontally elongated plastic body portion extending between the lower portions of said registering openings and defining an upwardly facing exterior housing surface spaced below said handle.

4. The improvement as defined in claim 2 wherein said housing and magazine assembly includes a sheet metal nosepiece of generally U-shaped cross-sectional configuration disposed with the bight portion thereof forwardly in vertically extending relation so that the interior surface thereof defines the forward portion of said drive track, the legs of said U-shaped nosepiece being disposed in interior abutting relation with the adjacent exterior surfaces of said metal side plates, and a second fastener extending between the legs of said nosepiece and through the portion of said side plates and plastic body disposed therebetween.

5. The improvement as defined in claim 3 wherein said spring means comprises elongated leaf spring means disposed within said handle, means for fixedly securing the rearward end portion of said elongated leaf spring means between the upper rearward portions of said metal side plates, means for connecting the forward end of said leaf spring means for movement with said staple driving element, said actuating means including releasable means engageable with an intermediate portion of said leaf spring means in relatively closely spaced relation to the forward end thereof connected with said staple driving element to move the latter through its spring stressing stroke and releasable therefrom at the end of said spring stressing stroke to allow said staple driving element to be moved through its staple driving stroke by the stressed leaf spring means.

6. The improvement as defined in claim 5 wherein said actuating means includes a lever pivoted intermediate its ends between said metal side plates above said leaf spring means for pivotal movement through a manually actuated arcuate stroke in one direction corresponding with the spring stressing stroke of said staple driving element and a return stroke, a pawl pivotally connected to the forward end of said lever, said pawl having lower hook means releasably engageable with said leaf spring means beneath the same, the pivotal axis of said lever, the pivotal axis of said pawl and the releasable engagement of said hook means with said leaf spring means being so relatively positioned that the movement of said lever through a predetermined initial portion of its manually engaged stroke serves to pivotally bias the hook means of said pawl into engagement with said leaf spring means as the latter is moved with said staple driving element through a corresponding initial portion of the spring stressing stroke of the latter, and means operable in response to the movement of said lever beyond said predetermined initial portion of its manually engaged stroke for releasing the hook means of said pawl from engagement with said leaf spring means.

7. The improvement as defined in claim 6 wherein said hook releasing means comprises an abutment carried by said lever for engaging said pawl and preventing further pivotal movement of said pawl with respect to said lever after said predetermined initial portion of its manually engaged stroke so that during the further movement of said lever said pawl is moved in fixed relation with said lever to effect the release of said hook means with said leaf spring means.

8. The improvement as defined in claim 6 or 7 wherein the forward end portion of said leaf spring means is of a reduced width defining a pair of transversely spaced forwardly facing shoulders, the hook means of said pawl comprising a pair of rigidly interconnected hook-shaped portions spaced apart a distance greater than the reduced width of said forward end portion of said leaf spring means and engageable with and beneath said shoulders.

9. The improvement as defined in claim 8 wherein a spring is provided in operative relation between said pawl and said lever for resiliently biasing said pawl in a direction to engage said abutment when said lever is moved beyond the predetermined initial portion of its manually engaged stroke, said hook-shaped portions including downwardly and rearwardly facing cam surfaces for engaging said shoulders during the return stroke of said lever to pivot said pawl in a direction against said spring bias, so as to enable said hook-shaped portions to engage beneath said shoulders.

10. The improvement as defined in claim 3, 5, 6 or 7 wherein said housing and magazine assembly includes a sheet metal nosepiece of generally U-shaped cross-sectional configuration disposed with the bight portion thereof forwardly in vertically extending relation so that the interior surface thereof defines the forward portion of said drive track, the legs of said U-shaped nosepiece being disposed in interior abutting relation with the adjacent exterior surfaces of said metal side plates, and a second fastener extending between the legs of said nosepiece and through the portion of said side plates and plastic body disposed therebetween.

11. The improvement as defined in claim 5, 6 or 7 wherein said means for fixedly securing the rearward end portion of said elongated leaf spring means comprises a pair of longitudinally spaced pins secured between said metal side plates and disposed on opposite sides of said leaf spring means, the portion of said leaf spring means associated with one of said pins having a transversely extending groove formed therein providing a segmental cylindrical pin engaging surface, said one pin including a spring engaging portion having a cylindrical exterior diameter disposed with its axis concentric with the axis of said segmental cylindrical surface.

12. The improvement as defined in claim 11 wherein said leaf spring means includes a plurality of leaf springs mounted together in generally longitudinally coextensive abutting relation.

13. The improvement as defined in claim 5, 6 or 7 wherein said means for connecting the opposite end portion of said leaf spring means with said metal side plates comprises a pair of longitudinally spaced pins secured to said side plates and disposed on opposite sides of said leaf spring means, one of said pins being secured between said side plates for pivotal movement about an axis extending transversely with respect to said side plates and longitudinally with respect to said one pin, detent means for releasably retaining said one pin in a plurality of different positions of pivotal movement about said axis, said one pin including a spring engaging cylindrical portion having an exterior spring engaging surface eccentric with respect to the pivotal axis of said one pin so that the extent of stress imparted to said leaf spring means during the spring stressing stroke of said staple driving element is varied between high and low limits depending upon the position at which said one pin is releasably retained by said detent means, and indicia means for indicating the position of said pin with respect to said high and low limits.

14. The improvement as defined in claim 13 wherein said spring engaging pin portion is cylindrical and wherein the portion of said leaf spring means engaged thereby is formed with a transversely extending groove providing a segmental cylindrical pin engaging surface disposed with its axis concentric with the axis of said cylindrical pin portion.

15. The improvement as defined in claim 14 wherein said leaf spring means includes a plurality of leaf springs mounted together in generally longitudinally coextensive abutting relation.

16. The improvement as defined in claim 1, 2, 3, 4, 5, 6 or 7 wherein said housing and magazine assembly further includes a magazine access member pivoted at its rearward end for vertical swinging movement between an operative horizontally extending position and an open position providing access to the portion of said channel defined by said sheet metal sides and said molded plastic body, said access member including a core rail portion for engaging beneath the staple crowns and between the interior surfaces of the staple legs of a staple stick received and guided within said channel when said access member is in said operative position, said access member having spring means thereon including a portion extending from the forward portion thereof to said pusher so as to bias said pusher in a forward direction when said access member is in said operative position, the arrangement being such that when said access member is pivoted away from said operative position the direction of bias of said spring means on said pusher changes from forwardly to rearwardly, means for releasably latching said access member in said operative position.

17. In a spring actuated fastener driving device comprising a housing defining a drive track, a fastener driving element slidably mounted in said drive track for movement through successive fastener driving cycles, each including a spring stressing stroke in one direction and a fastener driving stroke in an opposite direction, magazine means for receiving a supply of fasteners and feeding a leading fastener of the supply into said drive track during the spring stressing stroke of said fastener driving element for driving thereby during the fastener driving stroke thereof, elongated leaf spring means having one end connected for movement with said fastener driving element, means for connecting an opposite end portion of said leaf spring means with said housing such that said leaf spring means is stressed during the movement of said one end thereof with said fastener driving element through the spring stressing stroke of the latter, and actuating means for moving said fastener driving element through its spring stressing stroke and allowing said leaf spring means to move said fastener driving element through its fastener driving stroke, the improvement which comprises said actuating means including releasable means engageable with an intermediate portion of said leaf spring means in relatively closely spaced relation to the connection of said one end thereof with said fastener driving element to move the latter through its spring stressing stroke and releasable therefrom at the end of said spring stressing stroke to allow said fastener driving element to be moved through its fastener driving stroke by the stressed leaf spring means.

18. The improvement as defined in claim 17 wherein said actuating means includes a lever pivoted intermediate its ends to said housing for pivotal movement through a manually actuated arcuate stroke in one direction corresponding with the spring stressing stroke of said fastener driving element and a return stroke, a pawl pivotally connected to the one end of said lever, said pawl having hook means releasably engageable with said leaf spring means, the pivotal axis of said lever, the pivotal axis of said pawl and the releasable engagement of said hook means with said leaf spring means being so relatively positioned that the movement of said lever through a predetermined initial portion of its manually engaged stroke serves to pivotally bias the hook means of said pawl into engagement with said leaf spring means as the latter is moved with said fastener driving element through a corresponding initial portion of the spring stressing stroke of the latter, and means operable in response to the movement of said lever beyond said predetermined initial portion of its manually engaged stroke for releasing the hook means of said pawl from engagement with said leaf spring means.

19. The improvement as defined in claim 18 wherein said hook releasing means comprises an abutment carried by said lever for engaging said pawl and preventing further pivotal movement of said pawl with respect to said lever after said predetermined initial portion of its manually engaged stroke so that during the further movement of said lever said pawl is moved in fixed relation with said lever to effect the release of said hook means with said leaf spring means.

20. The improvement as defined in claim 18 or 19 wherein said one end portion of said leaf spring means is of a reduced width defining a pair of transversely spaced shoulders facing toward said one end, the hook means of said pawl comprising a pair of hook-shaped portions spaced apart a distance greater than the reduced width of said reduced end portion of said leaf spring means engageable with said shoulders and the adjacent surfaces of said leaf spring means.

21. The improvement as defined in claim 20 wherein a spring is provided in operative relation between said pawl and said lever for resiliently biasing said pawl in a direction to engage said abutment when said lever is moved beyond the predetermined initial portion of its manually engaged stroke, said hook-shaped portions including downwardly and forwardly facing cam surfaces for engaging said shoulders during the return stroke of said lever to pivot said pawl in a direction against said spring bias so as to enable said hook-shaped portions to engage beneath said shoulders.

22. The improvement as defined in claim 17, 18 or 19 wherein said means for fixedly securing the one end portion of said elongated leaf spring means comprises a pair of longitudinally spaced pins secured to said housing and disposed on opposite sides of said leaf spring means, the portion of said leaf spring means associated with one of said pins having a transversely extending groove formed therein providing a segmental cylindrical pin engaging surface, said one pin including a spring engaging portion having a cylindrical exterior diameter disposed with its axis concentric with the axis of said segmental cylindrical surface.

23. The improvement as defined in claim 22 wherein said leaf spring means includes a plurality of leaf springs mounted together in generally longitudinally coextensive abutting relation.

24. The improvement as defined in claim 17, 18 or 19 wherein said means for connecting the opposite end portion of said leaf spring means with said housing comprises a pair of longitudinally spaced pins secured to said housing and disposed on opposite sides of said leaf spring means, one of said pins being secured between said housing for pivotal movement about an axis extending transversely with respect to said housing and longitudinally with respect to said one pin, detent means for releasably retaining said one pin in a plurality of different positions of pivotal movement about said axis, said one pin including a spring engaging cylindrical portion having an exterior spring engaging surface eccentric with respect to the pivotal axis of said one pin so that the extent of stress imparted to said leaf spring means during the spring stressing stroke of said staple driving element is varied between high and low limits depending upon the position at which said one pin is releasably retained by said detent means and indicia means for indicating the position of said pin with respect to said high and low limits.

25. The improvement as defined in claim 24 wherein said spring engaging pin portion is cylindrical and wherein the portion of said leaf spring means engaged thereby is formed with a transversely extending groove providing a segmental cylindrical pin engaging surface disposed with its axis concentric with the axis of said cylindrical pin portion.

26. The improvement as defined in claim 25 wherein said leaf spring means includes a plurality of leaf springs mounted together in generally longitudinally coextensive abutting relation.

27. In a spring actuated fastener driving device comprising a housing defining a drive track, a fastener driving element slidably mounted in said drive track for movement through successive fastener driving cycles, each including a spring stressing stroke in one direction and a fastener driving stroke in an opposite direction, magazine means for receiving a supply of fasteners and feeding a leading fastener of the supply into said drive track during the spring stressing stroke of said fastener driving element for driving thereby during the fastener driving stroke thereof, elongated leaf spring means having one end connected for movement with said fastener driving element, means for connecting an opposite end portion of said leaf spring means with said housing such that said leaf spring means is stressed during the movement of said one end thereof with said fastener driving element through the spring stressing stroke of the latter, and actuating means for moving said fastener driving element through its spring stressing stroke and allowing said leaf spring means to move said fastener driving element through its fastener driving stroke, the improvement which comprises said means for connecting the opposite end portion of said leaf spring means with said housing comprising a pair of longitudinally spaced pins secured to said housing and disposed on opposite sides of said leaf spring means, one of said pins being secured between said housing for pivotal movement about an axis extending transversely with respect to said housing and longitudinally with respect to said one pin, detent means for releasably retaining said one pin in a plurality of different positions of pivotal movement about said axis, said one pin including a spring engaging cylindrical portion having an exterior spring engaging surface eccentric with respect to the pivotal axis of said one pin so that the extent of stress imparted to said leaf spring means during the spring stressing stroke of said staple driving element is varied between high and low limits depending upon the position at which said one pin is releasably retained by said detent means, and indicia means for indicating the position of said pin with respect to said high and low limits.

28. The improvement as defined in claim 27 wherein said spring engaging pin portion is cylindrical and wherein the portion of said leaf spring means engaged thereby is formed with a transversely extending groove providing a segmental cylindrical pin engaging surface disposed with its axis concentric with the axis of said cylindrical pin portion.

29. The improvement as defined in claim 28 wherein said leaf spring means includes a plurality of leaf springs mounted together in generally longitudinally coextensive abutting relation.

30. The improvement as defined in claim 27, 28 or 29 wherein said one pin includes an enlarged head, said head and said housing having opposed abutting annular surfaces disposed in a common plane extending radially with respect to said one pin, one of said annular surfaces having a series of annularly spaced depressions formed therein, the other of said annular surfaces having a corresponding series of complementarily shaped projections formed therein and spring means between said one pin and said housing for resiliently biasing said pin longitudinally in a direction to engage said annular surfaces.

31. The improvement as defined in claim 30 wherein indicia means includes an arrow on said head and stress limiting indicia on said housing.

32. The improvement as defined in claim 30 wherein said head is formed with an exterior coin receiving slot enabling an operator to pivot said one pin by means of a coin engaged in said slot.

33. In a spring actuated fastener driving device comprising a housing defining a drive track, a fastener driving element slidably mounted in said drive track for movement through successive fastener driving cycles, each including a spring stressing stroke in one direction and a fastener driving stroke in an opposite direction, magazine means for receiving a supply of fasteners and feeding a leading fastener of the supply into said drive track during the spring stressing stroke of said fastener driving element for driving thereby during the fastener driving stroke thereof, elongated leaf spring means having one end connected for movement with said fastener driving element, means for connecting an opposite end portion of said leaf spring means with said housing such that said leaf spring means is stressed during the movement of said one end thereof with said fastener driving element through the spring stressing stroke of the latter, and actuating means for moving said fastener driving element through its spring stressing stroke and allowing said leaf spring means to move said fastener driving element through its fastener driving stroke, the improvement which comprises said means for connecting the opposite end portion of said leaf spring means with said housing comprising a pair of longitudinally spaced pins secured to said housing and disposed on opposite sides of said leaf spring means, the portion of said leaf spring means associated with one of said pins having a transversely extending groove formed therein providing a segmental cylindrical pin engaging surface, said one pin including a spring engaging portion having a cylindrical exterior diameter disposed with its axis concentric with the axis of said segmental cylindrical surface.

34. The improvement as defined in claim 33 wherein said leaf spring means includes a plurality of leaf springs mounted together in generally longitudinally coextensive abutting relation.

* * * * *